US005451112A

United States Patent [19]

Ito

[11] Patent Number: 5,451,112

[45] Date of Patent: Sep. 19, 1995

[54] PRINTER AND METHOD OF SWITCHING RIBBON TRACKS OF INK RIBBON

[75] Inventor: Masashi Ito, Shizuoka, Japan

[73] Assignee: Star Micronics Co., Ltd., Shizuoka, Japan

[21] Appl. No.: 322,372

[22] Filed: Oct. 13, 1994

Related U.S. Application Data

[63] Continuation of Ser. No. 147,079, Nov. 3, 1993, abandoned.

[30] Foreign Application Priority Data

Nov. 6, 1992 [JP] Japan ..... 4-322705

[51] Int. Cl.[6] ..... B41J 33/54

[52] U.S. Cl. ..... 400/212; 400/247

[58] Field of Search ..... 400/211, 212, 213, 215.1, 400/215.2, 215.3, 215.4, 216, 216.1, 216.2, 216.3, 216.4, 216.5, 217, 247

[56] References Cited

U.S. PATENT DOCUMENTS

| | | | |
|---|---|---|---|
| 4,606,661 | 8/1986 | Aldrich et al. | 400/213 |
| 5,067,833 | 11/1991 | Gomoll et al. | 400/213 |
| 5,080,511 | 1/1992 | Iwata | 400/216.1 |
| 5,112,150 | 5/1992 | Iwata | 400/216.1 |

FOREIGN PATENT DOCUMENTS

| | | | |
|---|---|---|---|
| 4028861 | 8/1961 | Japan . | |
| 51-11528 | 4/1976 | Japan . | |
| 0256683 | 11/1987 | Japan | 400/216.1 |
| 3193382 | 8/1991 | Japan | 400/216.1 |

*Primary Examiner*—Ren Yan

*Attorney, Agent, or Firm*—Whitham, Curtis, Whitham & McGinn

[57] ABSTRACT

Disclosed are a printer and a method of switching ribbon tracks of an ink ribbon. The printer uses an ink ribbon having a plurality of ribbon tracks of the same color and properly switches the ribbon tracks from one to another in a printing operation. This ribbon-track switching method switches the ribbon tracks from one to another when a printing page is changed or an equivalent operation is executed. It is therefore possible to suppress a decrease in printing density to thereby prolong the service life of the ink-ribbon cartridge. Since the ribbon tracks are switched from one to another when a printing page is changed or an equivalent operation is executed, thus inhibiting the switching of the ribbon tracks on the same page, the printing density on the same page becomes even and the printing quality can be improved.

16 Claims, 10 Drawing Sheets

PRINTER AND METHOD OF SWITCHING RIBBON TRACKS OF INK RIBBON

This is a Continuation of application Ser. No. 08/147,079 filed Nov. 3, 1993, now abandoned.

BACKGROUND OF THE INVENTION

1. Field of the Invention

The present invention relates to a printer and a method of switching ribbon tracks of an ink ribbon, and, more particularly, to a scheme of suppressing a decrease in ink density to prolong the service life of a single ink-ribbon cartridge and to prevent the occurrence of a significant variation in printing density on the same page.

2. Description of the Related Art

An ink-ribbon cartridge 101, as shown in FIGS. 12 and 13, is mounted on a printer of a wire-dot matrix type, for example. This type of ink-ribbon cartridge 101 comprises a case 103, and an endless type ink ribbon 105 retained in the case 103. This ink ribbon 105 consists of a single ribbon track so that the same ribbon track is repeatedly used.

The prior art structure has the following drawback. Since the ink ribbon 105 consists of a single ribbon track, the same ribbon track is used over and over again, causing the printing density to become low relatively earlier, as mentioned above. This inevitably shortens the life of the single ink-ribbon cartridge 101. This requires the frequent replacement of the ink-ribbon cartridge 101, which is troublesome.

The above problem will now be described more specifically with reference to FIG. 14. In FIG. 14, for example, a ribbon track area extending from $a_2$ to $b_2$ is used to print on a printing page $P_1$, a ribbon track area extending from $b_2$ to $c_2$ is used to print on a printing page $P_2$, a ribbon track area extending from $c_2$ to $d_2$ is used to print on a printing page $P_3$, and a ribbon track area extending from $d_2$ to $e_2$ is used to print on a printing page $P_4$. The endless type ink ribbon 105 loops back and the same ribbon track areas will be used again. In other words, the same ribbon track areas are always repeatedly used. Accordingly, the printing density quickly becomes lower, and the life of the ink-ribbon cartridge 101 expires quickly.

The prior art systems are disclosed in, for example, Japanese Examined Patent Publication Nos. sho 40-28861 and sho 51-11528.

SUMMARY OF THE INVENTION

It is therefore an object of the present invention to provide a printer and a method of switching ribbon tracks of an ink ribbon, which will suppress a decrease in ink density to prolong the service life of a single ink-ribbon cartridge and to prevent the occurrence of a variation in printing quality on the same page.

To achieve this object, according to one aspect of this invention, there is provided a printer comprising an ink ribbon having a plurality of ribbon tracks of the same color arranged side by side across the ink ribbon; and means of properly switching the ribbon tracks from one to another in a printing operation.

The printer of this invention further comprises means of inhibiting switching of the ribbon tracks during printing on the same page.

The printer of this invention further comprises control means for switching the ribbon tracks when the top of a new page is fed to a printing position or new paper is loaded.

According to another aspect of this invention, there is provided a method of switching ribbon tracks of an ink ribbon, comprising the step of switching a plurality of ribbon tracks of the same color of an ink ribbon from one to another when a printing page is changed or an equivalent operation is executed.

According to the method of this invention, paper to be used may be continuous paper or cut sheets of paper.

According to the method of this invention, if the paper in use is continuous paper, the number of steps of a stepping motor for feeding the paper is managed to discriminate whether or not a printing page has been changed or an equivalent operation has been executed.

According to this invention, an ink ribbon having a plurality of ribbon tracks of the same color is used and the ribbon tracks are properly switched from one to another in a printing operation, and, more particularly, the switching of the ribbon tracks is executed when a printing page is changed or an equivalent operation is executed. It is therefore possible to suppress a decrease in printing density to thereby prolong the service life of the ink-ribbon cartridge. Since the ribbon tracks are switched from one to another when a printing page is changed or an equivalent operation to the loading of a new printing page is executed, thus inhibiting the switching of the ribbon tracks on the same page, the printing density on the same page becomes even and the printing quality can be improved.

DETAILED DESCRIPTION OF THE PREFERRED EMBODIMENT

Figure 1:
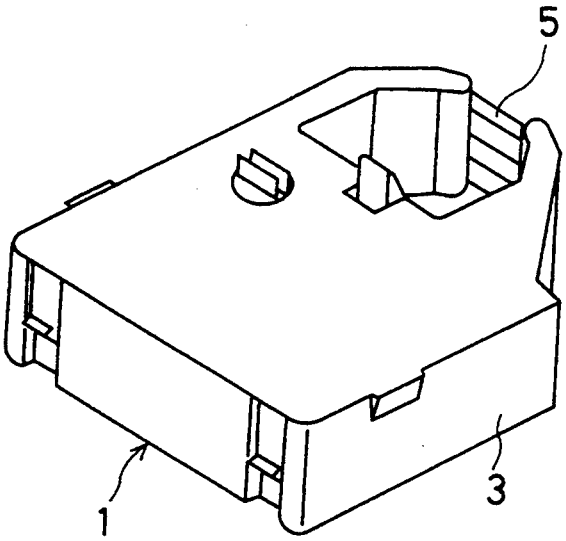
FIG. 1 is a perspective view of an ink-ribbon cartridge according to one embodiment of the present invention.
Figure 2:
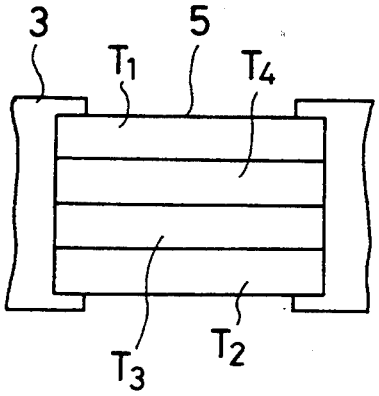
FIG. 2 is a front view showing the structure of a part of the ink-ribbon cartridge according to this embodiment.
Figure 3:
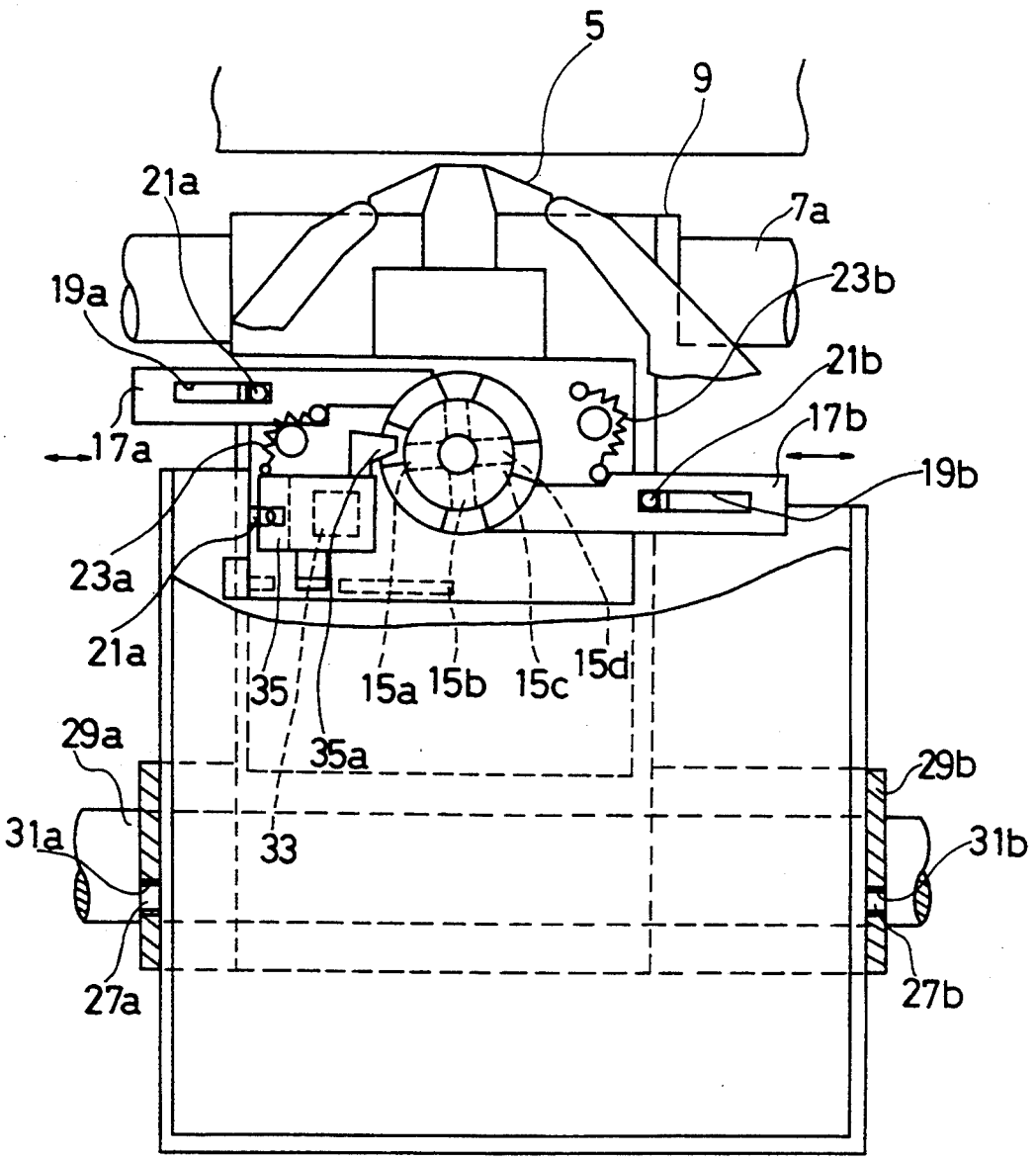
FIG. 3 is a plan view showing a mechanism of switching the ribbon tracks of the ink-ribbon cartridge according to this embodiment.

A preferred embodiment of the present invention will now be described referring to FIGS. 1 through 11. To begin with, the structure of an ink-ribbon cartridge 1 used in this embodiment will be described referring to FIGS. 1 and 2. The ink-ribbon cartridge 1 comprises a case 3, and an endless type ink ribbon 5 retained in the case 3. Driving means for moving the ink ribbon 5 in a loop is disposed in the case 3. As shown in FIG. 2, the ink ribbon 5 is wide and consists of four ribbon tracks $T_1$, $T_2$, $T_3$ and $T_4$. Those ribbon tracks $T_1$ to $T_4$ are all black in color.

Switching means for switching the ribbon tracks $T_1$ to $T_4$ of the ink ribbon 5 from one to another may take various structures. One example of the structure of this switching means is shown in FIGS. 3 to 7. This structure, which is disclosed in Japanese Unexamined Patent Publication No. sho 63-254089, has parallel guide bars 7*a* and 7*b* provided on the main body of a printer. Further, a carriage 9 is provided in such a way that it can move back and forth along the guide bars 7*a* and 7*b*.

Figure 4:
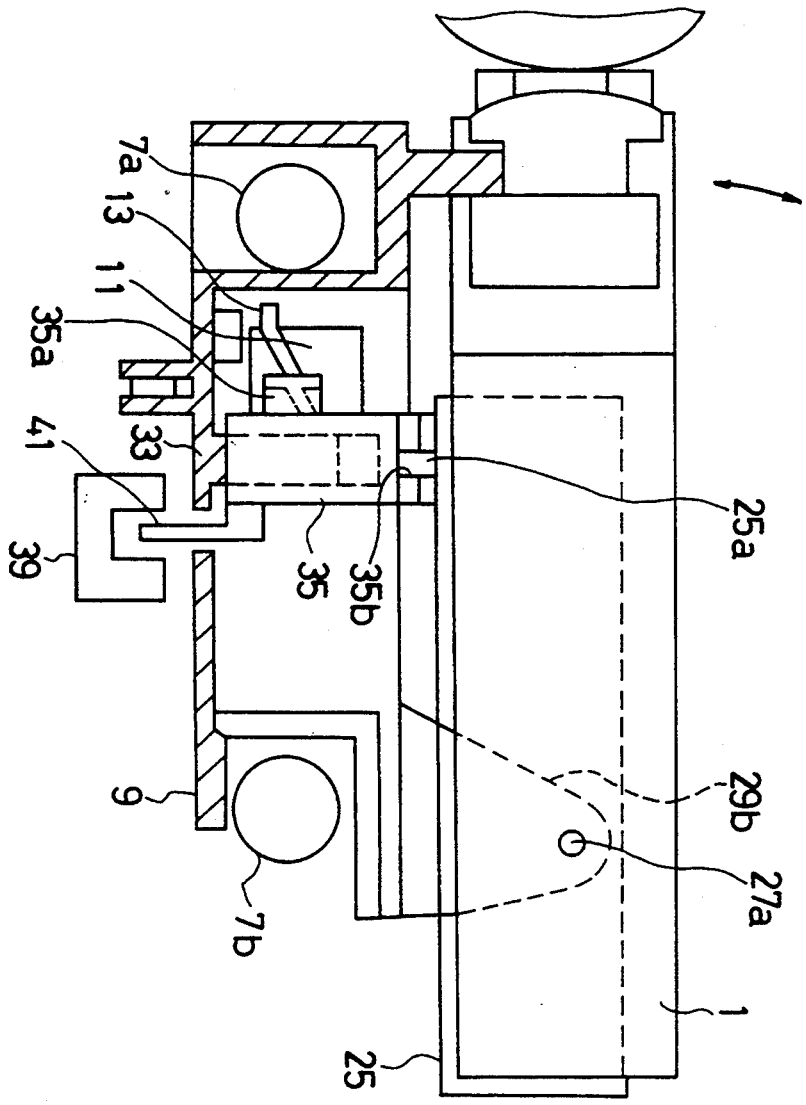
FIG. 4 PRIOR ART
FIG. 4 is a side cross-sectional view showing the mechanism of switching the ribbon tracks of the ink-ribbon cartridge according to this embodiment.
Figure 5:
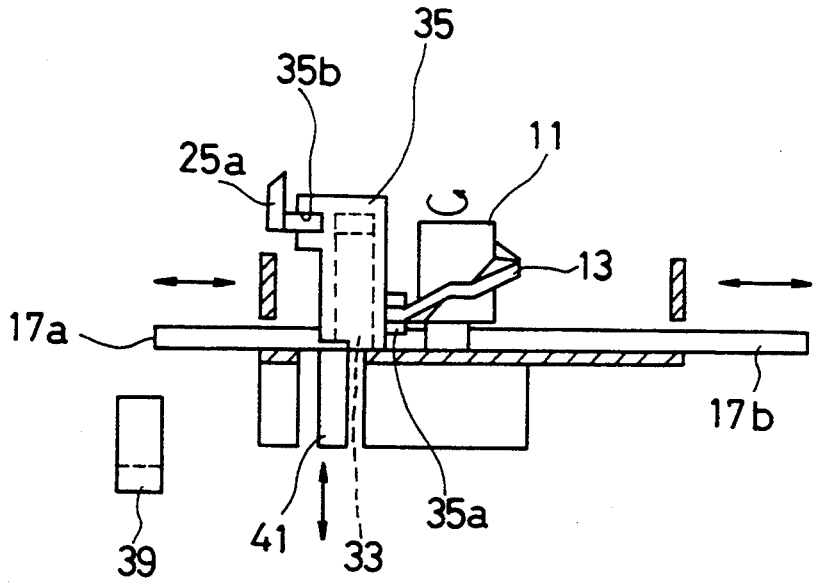
FIG. 5 is a side view showing the structure of a part of the mechanism of switching the ribbon tracks of the ink-ribbon cartridge according to this embodiment.
Figure 6:
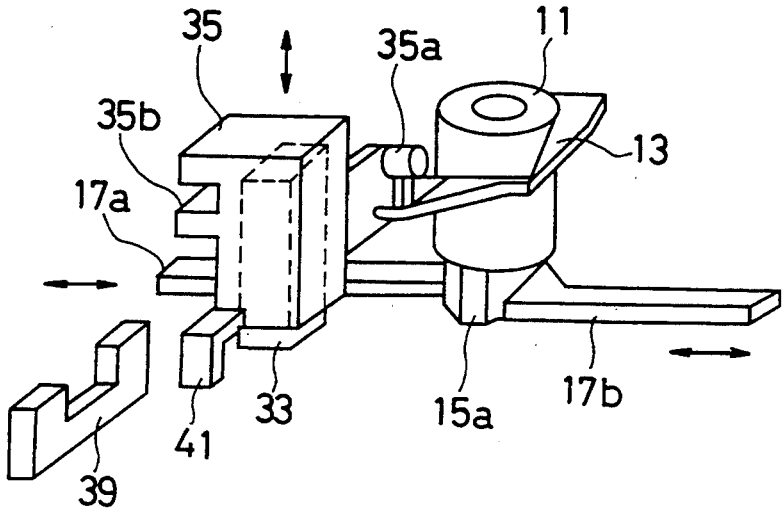
FIG. 6 is a perspective view showing the structure of the part of the ribbon-track switching mechanism shown in FIG. 5.
Figure 7:
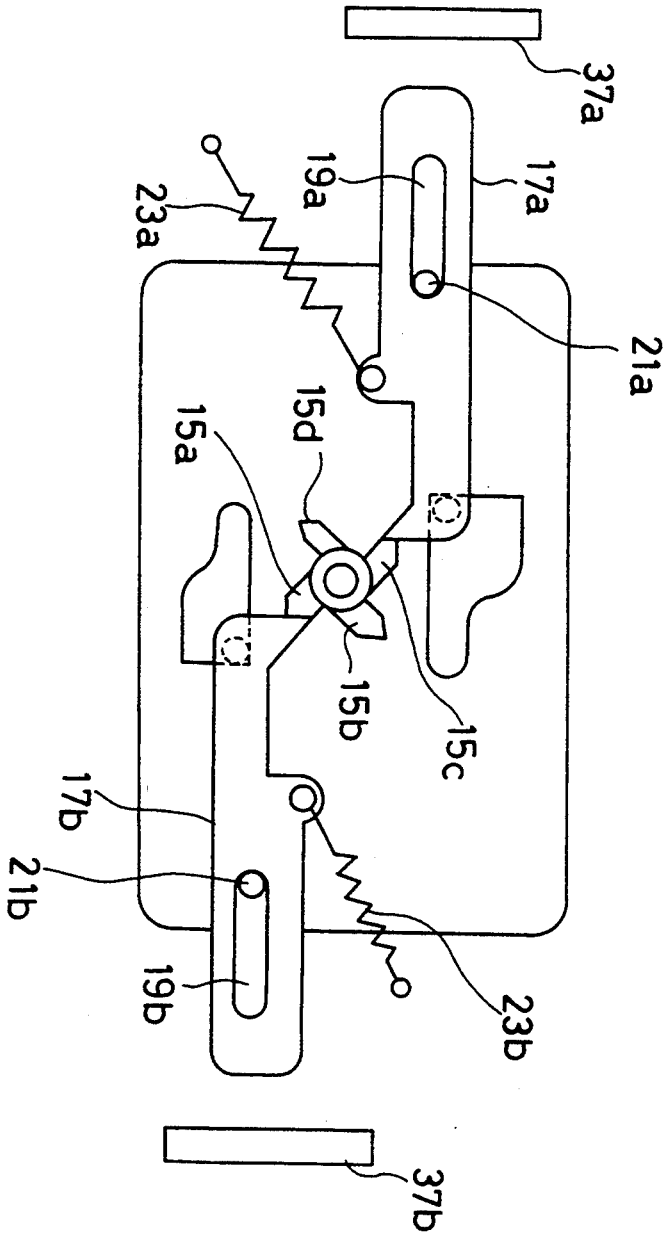
FIG. 7 PRIOR ART
FIG. 7 is a partly plan view showing the mechanism of switching the ribbon tracks of the ink-ribbon cartridge according to this embodiment.

A lifting cam 11 is attached, rotatable in one direction, to the interior of the carriage 9, as shown in FIGS. 4 to 6. A cam 13 is formed like a step at the outer surface of the lifting cam 11. Four pawls 15*a*, 15*b*, 15*c* and 15*d* are protrusively provided at equal intervals in the circumferential direction at the bottom portion of the lifting cam 11 as shown in FIG. 7. Switching levers 17*a* and 17*b* protrude from the respective sides of the carriage 9. Elongated grooves 19*a* and 19*b* are respectively formed in the switching levers 17*a* and 17*b*, with pins 21*a* and 21*b* engaged with the associated grooves 19*a* and 19*b*. When the switching levers 17*a* and 17*b* move along the pins 21*a* and 21*b* within the range of the grooves 19*a* and 19*b*, the distal ends of the switching levers 17*a* and 17*b* are selectively engaged with the pawls 15*a*, 15*b*, 15*c* and 15*d*. The switching levers 17*a* and 17*b* are always urged outward in FIGS. 3 and 7 by springs 23*a* and 23*b*, respectively.

An ink-ribbon holder 25 is placed above the carriage 9, and the ink-ribbon cartridge 1 described above is mounted on the holder 25. A pair of pins 27*a* and 27*b* are protrusively provided on the respective sides of the ink-ribbon holder 25. Those pins 27*a* and 27*b* are respectively engaged with holes 31*a* and 31*b*, formed in a pair of angle members 29*a* and 29*b*, respectively. The ink-ribbon holder 25 is swingable around the pins 27*a* and 27*b*.

A guide 33 protrudes from the surface of the carriage 9, with a lifting lever 35 fitted, movable up and down, on the guide 33 from above as shown in FIG. 4. This lifting lever 35 is provided with a guide 35*a*, which clutches the step-shaped cam 13. The lifting lever 35 has a groove 35*b*, as shown in FIG. 5, in which a pin 25*a* protruding from the bottom of the ink-ribbon holder 25 is fitted. As shown in FIG. 7, stoppers 37*a* and 37*b* are provided to push the switching levers 17*a* and 17*b* back when the carriage 9 moves beyond a printing area. The stoppers 37*a* and 37*b* may be side plates which support the entire printing mechanism. In the diagrams, reference numeral "39" denotes detecting means for detecting the home position of the carriage 9, and reference numeral "41" denotes a screen plate for the detecting means 39.

With the above structure, when the carriage 9 moves beyond the normal printing area rightwards with the state shown in FIG. 7, the switching lever 17*b* hits against the stopper 37*b*. At this time, the lifting cam 11 is positioned by the load of an index spring (not shown). When the carriage 9 moves further rightwards in FIG. 7, the switching lever 17*b* moves leftwards in the diagram against the urging force of the spring 23*b*. At this time, the switching lever 17*b* pushes the pawl 15*a* of the lifting cam 11 to cause the lifting cam 11 to make a $\frac{1}{4}$ turn. The power of the index spring to hold the lifting cam 11 is set stronger than the springs 23*a* and 23*b*.

When the carriage 9 moves leftwards in FIG. 5, the switching lever 17*b* moves away from the stopper 37*b* and returns to the original position by the force of the spring 23*b*. At this time, the distal end of the switching lever 17*b* moves over the pawl 15*b*. The lifting cam 11 makes a half turn when the above action is repeated twice, makes a $\frac{3}{4}$ turn when that action is repeated three times, and finally makes a full turn when the above action is repeated four times. Every time the lifting cam 11 makes a $\frac{1}{4}$ turn, the lifting lever 35 moves up or down via the cam 11 and the ink-ribbon holder 25 swings accordingly to shift the ink-ribbon cartridge 1 retained in the holder 25 in four steps. Consequently, the ribbon tracks $T_1$, $T_2$, $T_3$ and $T_4$ of the ink ribbon 5 are sequentially switched from one to another. The ribbon-track switching mechanism described above is just one example, and another mechanism may of course be used.

Figure 8:
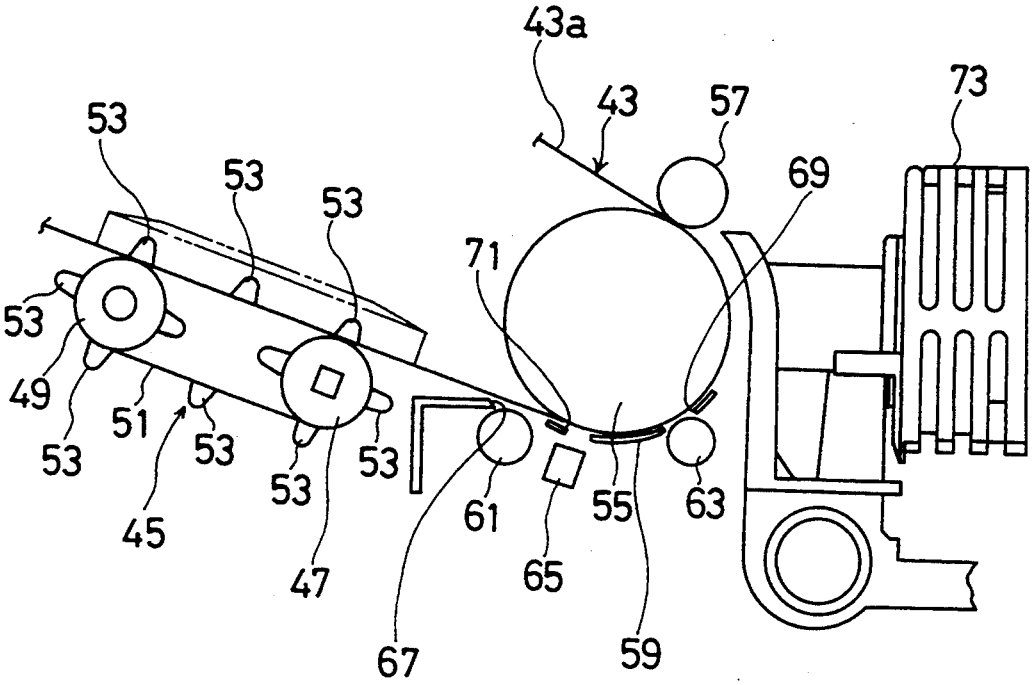
FIG. 8 is a side view of a paper feeding mechanism used to explain the page management according to this embodiment.

As the switching of the ribbon tracks $T_1$ to $T_4$ of the ink ribbon 5 is executed when the printing page is changed in this embodiment, the page management of this embodiment will be described below with reference to the case where continuous paper is used. FIG. 8 illustrates a mechanism for feeding continuous paper 43. This mechanism has a push tractor 45, which comprises a drive pulley 47, a driven pulley 49 and a belt 51 put around the driving pulley 47 and the driven pulley 49. A plurality of pins 53 are attached at given pitches to the belt 51. The driving pulley 47 is given the rotational power from a stepping motor (not shown). The continuous paper 43 has sheets of paper 43*a* of a given length connected by lines of perforations formed across the paper 43 at the given lengths, and the sheets of paper 43*a* are folded at those lines of perforations. The continuous paper 43 also has holes formed on both sides at given pitches where the pins 53 of the push tractor 45 are to be fitted.

A platen 55 is disposed in the paper feeding direction of the continuous paper 43. This platen 55 is driven in synchronism with the driving of the push tractor 45. A bail roller 57 is disposed above and facing the platen 55 in FIG. 8. The bail roller 57 presses the fed continuous paper 43 against the platen 55. A paper chute 59 is located under the platen 55 in the diagram. Disposed on the opposite side of the paper chute 59 to the platen 55 are pinch rollers 61 and 63 and paper detecting means 65. The paper detecting means 65 is an optical detector, and senses the leading end of the fed continuous paper 43. Openings 67, 69 and 71 are respectively formed in those portions of the paper chute 59 where the pinch rollers 61 and 63 and the paper detecting means 65 are located. FIG. 8 shows the pinch rollers 61 and 63 retreated at the pressure releasing positions.

With the above structure, every sheet 43*a* of the continuous paper fed out by the push tractor 45 comes between the platen 55 and the paper chute 59 to be put around the platen 55. As the sheet 43*a* is put around the platen 55, it is pressed against the platen 55 by the bail roller 57. Under this situation, printing is performed by a printing head 73 through an arbitrary one of the ribbon tracks $T_1$ to $T_4$ of the ink ribbon 5. With regard to the page management, the number of steps (of the stepping motor) necessary to feed a single sheet 43*a* defined between two lines of perforations is set previously. Changing to the next sheet 43*a* can be detected by managing the number of steps.

The page management will be described in more detail below. At the time the sheet 43*a* of the continuous paper 43 is fed, the current position of that sheet 43*a* is always detected and memorized by accumulating the number of steps of the stepping motor. The number of steps of the stepping motor is previously set in accordance with the page length of every sheet 43*a* of the continuous paper 43. Pages change when the accumulated number of steps exceeds the stored number of steps corresponding to the page length of a single sheet 43*a*. A top of form of the sheet 43*a* is detected in the following manner. The top of form is a reference position of a page for paper feed. When a printing page is changed or an equivalent operation is executed, paper is fed until the top of form of the next page comes to a printing position. If the sheet 43*a* is already set (or present at the detecting position of the paper detecting means 65) when the printer is activated, the current position is considered as the top of form. If the sheet 43*a* is not present at the detecting position upon activation of the printer, on the other hand, when the detection result changes from "no paper" to "paper present" during the feeding of the sheet 43*a*, i.e., when the paper detecting means 65 detects the leading end of the sheet 43*a*, the sheet 43*a* is fed by a predetermined distance corresponding to the distance between the paper detecting means 65 and the printing head 73. This position is considered as the top of form. By counting the number of steps of the stepping motor, it is possible to easily discriminate whether or not the sheet 43*a* has been fed by the predetermined distance.

The page management will now be described more specifically. A vertical location counter (hereinafter referred to as "VLC") is provided in the page managing portion of the printer. This VLC is accomplished by a specific area in a RAM serving as a counter. The VLC counts and accumulates the number of steps as the sheet 43*a* is fed. Suppose that the page length of a single sheet 43*a* of the continuous paper 43 is 10 inches and this 10-inch sheet 43*a* is fed out in 3600 ($10\times360$ steps/inch) steps. In this case, pages change when the accumulation result of the number of steps of a single sheet 43*a* of the continuous paper 43 exceeds 3600 steps from the top of form. When the accumulated number of steps exceeds 3600 steps, the VLC is reset and the counting will start from 0, so that the paper feeding position of the next single sheet 43*a* can be detected. In other words, the current position of a single sheet 43*a* can always be monitored by recognizing any number of steps, from 0 to 3559. The number of steps "3600" is just one example, and may be set to any number.

Figure 9A:
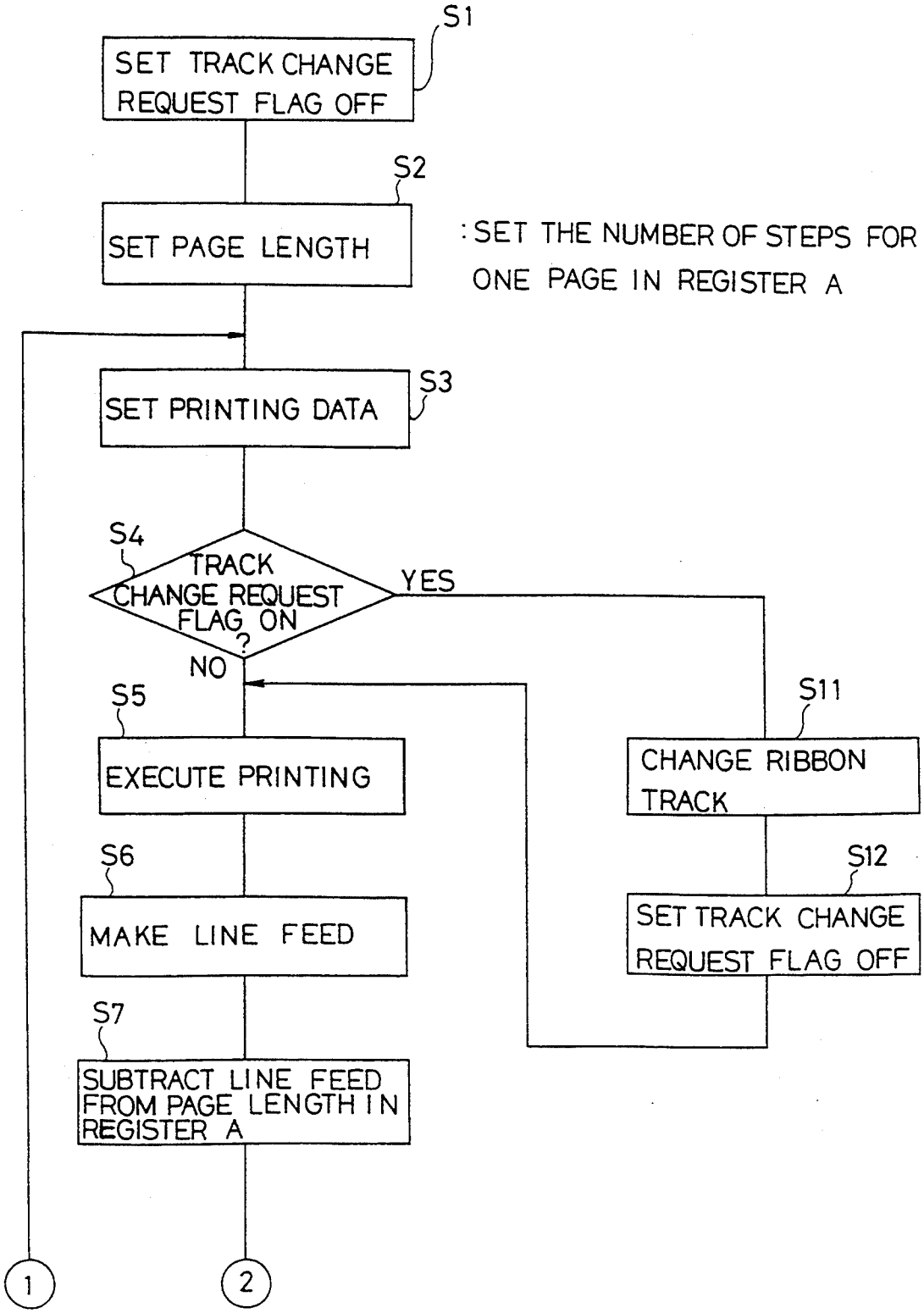
FIGS. 9A and 9B are flowcharts illustrating how the ribbon tracks of an ink-ribbon cartridge are switched from one to another according to this embodiment.
Figure 9B:
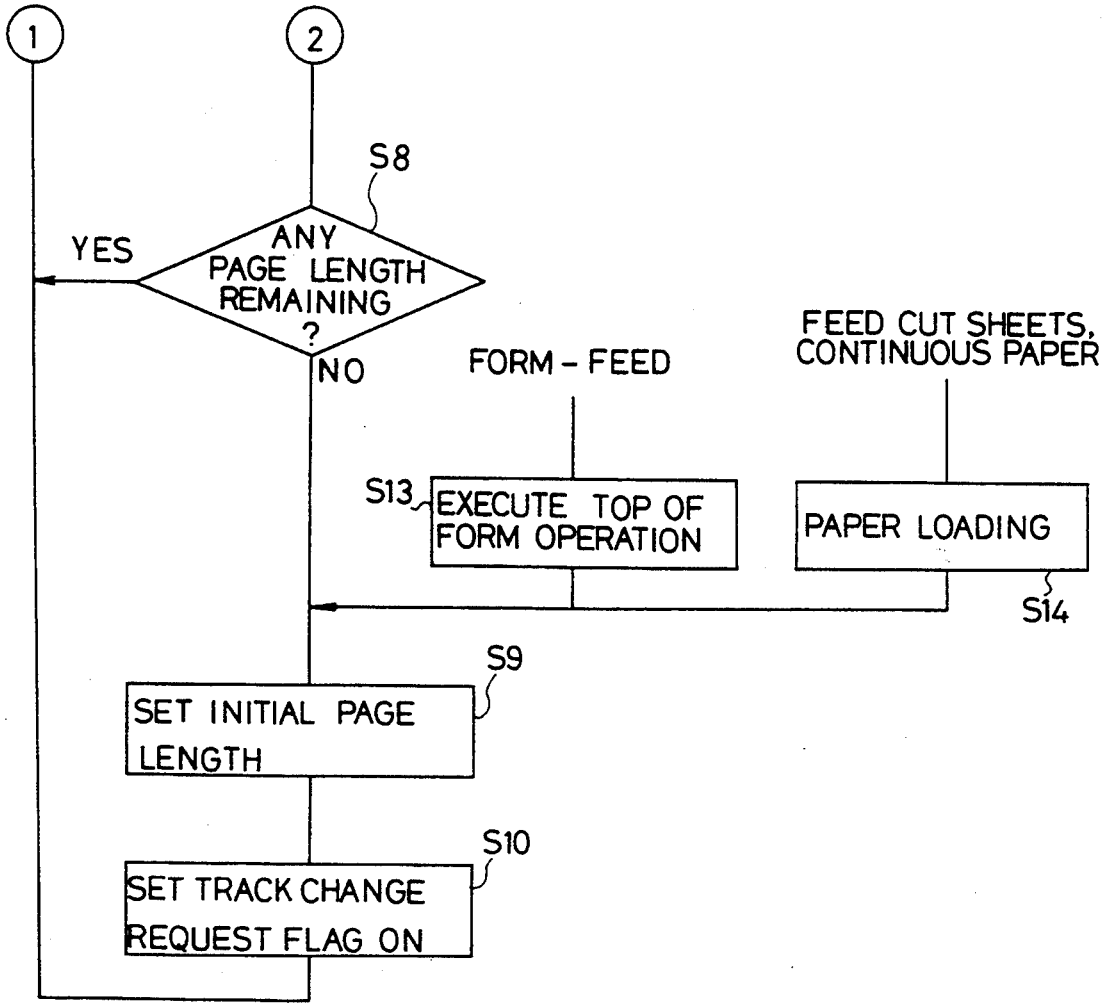

With the above description in mind, the operation of the printer will now be described along the flowchart given in FIGS. 9A and 9B. First, as an initialization, a track change request flag for switching the ribbon tracks $T_1$ to $T_4$ of the ink ribbon 5 from one to another is set off (step S1). This track change request flag is set on or off at one address in the aforementioned RAM by using one bit of one byte at that address. Next, the page length is set (step S2). More specifically, an operation register A (VLC) for controlling the page length is provided in the RAM and the number of steps corresponding to the page length of the sheet 43*a* is set in the register A. Through the above steps, the initialization is completed.

Then, printing data is set (step S3) to make the printer ready to print, and the flow advances to step S4. In this step S4, the ON/OFF status of the track change request flag is discriminated. As the track change request flag is set off in the aforementioned step S1, it is still off in the first discrimination in step S4, so that the flow goes to step S5 to execute printing. When printing of one line is complete in step S5, a line feed is executed (step S6). When a line feed is executed, a predetermined number of steps corresponding to one line is subtracted from the preset number of steps corresponding to the page length in the register A (step S7).

Then, the flow goes to step S8 where the remaining number of steps in the register A is determined. If there are any steps left, the flow returns to step S3 and the above-described operation will be repeated. If it is determined that there are no steps left, on the other hand, the flow advances to step S9. In this step S9, the page length in the register A is reset to the number of steps corresponding to the page length. This page management has already been described above. In the next step S10, the track change request flag is set on. The printer is now ready for switching the ribbon tracks when a change of page is executed. From that point, the flow moves to step S3 to set printing data again. This is to make the printer ready to print the first line of the next page. Then, the flow goes to step S4 where the ON/OFF status of the track change request flag is discriminated.

As the track change request flag is on this time, the flow advances to step S11. In this step S11, the switching of the ribbon tracks $T_1$, $T_2$, $T_3$ and $T_4$ from one to another is executed. When this ribbon-track switching is complete, the track change request flag is set off before the flow goes to step S5. The printing, the page change, and the switching of the ribbon tracks $T_1$–$T_4$ of the ink ribbon 5 are conducted in the above-mentioned manner.

The switching of the ribbon tracks $T_1$–$T_4$ of the ink ribbon 5 is performed not only by the page change during printing but also by an equivalent operation. As shown in FIG. 9B, when the top of form of the next page is executed in response to a command (a form-feed (FF) code which means that one page has ended and paper is fed until the top of form of the next page comes to the printing position) in step S13, the flow goes to step S9 and thereafter the switching of the ribbon tracks $T_1$–$T_4$ of the ink ribbon 5 will be executed through the same steps as described above. Even when the sheet 43*a* is loaded by the feeding of the continuous paper 43 or a cut sheet of paper is loaded (step S14), the flow goes to step S9 and thereafter the switching of the ribbon tracks $T_1$–$T_4$ of the ink ribbon 5 will be executed through the same steps as described above.

Figure 10:
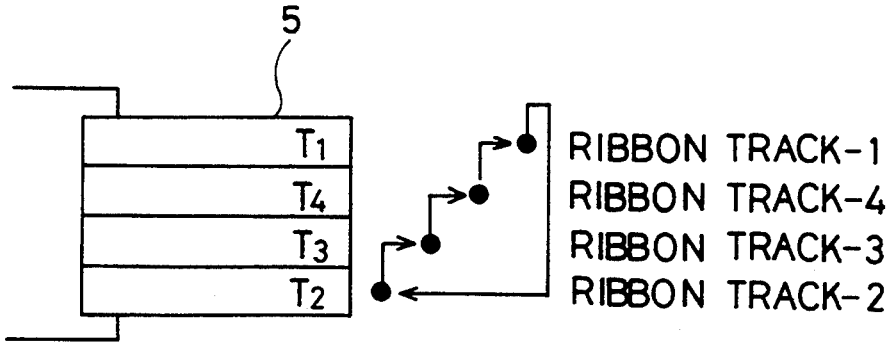
FIG. 10 is a diagram for explaining the order of the switching of the ribbon tracks of an ink-ribbon cartridge according to this embodiment.
Figure 11:
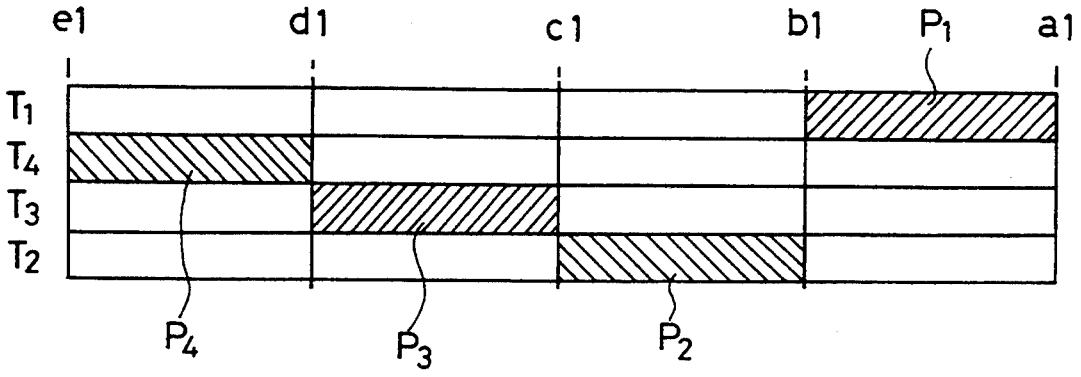
FIG. 11 is another diagram for explaining the order of the switching of the ribbon tracks of an ink-ribbon cartridge according to this embodiment.
Figure 12:
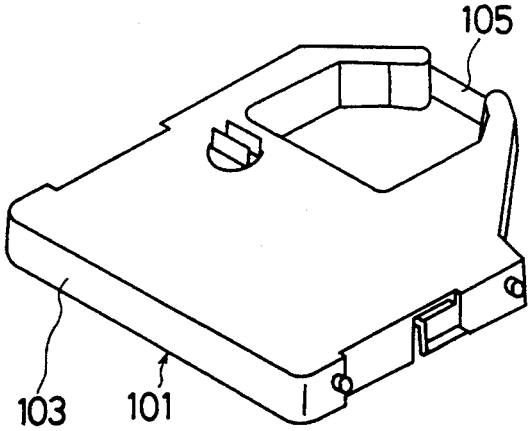
FIG.12 PRIOR ART
FIG. 12 is a perspective view of a conventional ink-ribbon cartridge.
Figure 13:
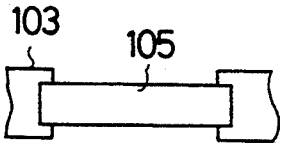
FIG.13 PRIOR ART
FIG. 13 is a front view showing the structure of a part of the conventional ink-ribbon cartridge.
Figure 14:
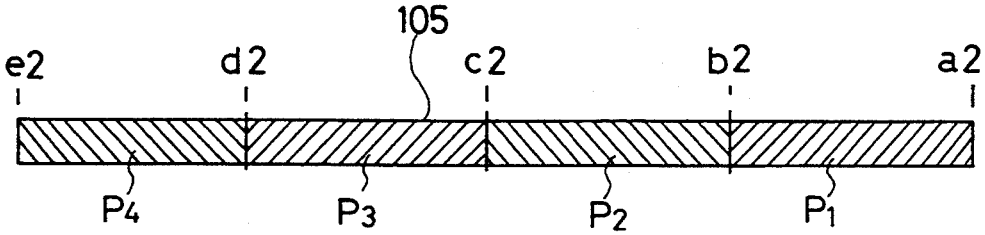
FIG.14 PRIOR ART
FIG. 14 is a diagram showing how the ribbon tracks of the conventional ink-ribbon cartridge are used.

When the switching of the ribbon tracks $T_1$–$T_4$ of the ink ribbon 5 is executed through the above-described steps, the ribbon tracks $T_1$ to $T_4$ are used as shown in FIGS. 10 and 11. FIG. 10 illustrates how the ink ribbon 5 is used when four pages are continuously printed starting from the ribbon track $T_1$. The switching of the ribbon tracks $T_1$–$T_4$ of the ink ribbon 5 is executed in the sequence shown in FIG. 10. That is, the ribbon track $T_1$ is used first, the ribbon track $T_2$ is used next, the ribbon track $T_3$ is used next, and the ribbon track $T_4$ is used finally.

Referring to FIG. 11, the first page is printed using the area of the ribbon track $T_1$ from $a_1$ to $b_1$. The position $b_1$ is where pages change from the first page to the second page and where the ribbon track of the ink ribbon changes from $T_1$ to $T_2$. The second page is printed using the area of the ribbon track $T_2$ from $b_1$ to $c_1$. The position $c_1$ is where pages change from the second page to the third page and where the ribbon track of the ink ribbon changes from $T_2$ to $T_3$. Likewise, the third page is printed using the area of the ribbon track $T_3$ from $c_1$ to $d_1$. The position $d_1$ is where pages change from the third page to the fourth page and where the ribbon track of the ink ribbon changes from $T_3$ to $T_4$. The fourth page is printed using the area of the ribbon track $T_4$ from $d_1$ to $e_1$.

This embodiment has the following advantages. First, the lowering of the ink density of the ink ribbon 5 can be suppressed, thus improving the printing quality as well as prolonging the service life of the ink-ribbon cartridge 1. This avoids frequent, troublesome replacement of the ink-ribbon cartridge. This advantage is achieved by designing the ink ribbon 5 of the ink-ribbon cartridge to have a plurality of ribbon tracks (four in this embodiment) $T_1$, $T_2$, $T_3$ and $T_4$, and changing those four ribbon tracks from one to another page by page. In particular, since the switching of the ribbon tracks $T_1$–$T_4$ of the ink ribbon 5 from one to another is conducted page by page and the ribbon-track switching within the same page is inhibited, the printing density will not significantly vary within the same page. Therefore, the printing quality is also improved, and the user will not particularly be bothered by uneven printing density.

Although only one embodiment of the present invention has been described herein, it should be apparent to those skilled in the art that the present invention may be embodied in many other specific forms without departing from the spirit or scope of the invention. For instance, the number of the ribbon tracks of the ink ribbon is not limited to four, but may be two, three, or five or greater. Further, the printing color is not limited to black and may take another color. The mechanism for switching the ribbon tracks is in no way restrictive to the illustrated one.

Although the foregoing description of this embodiment has been given with reference to the case where continuous paper is used, this invention can also applied to the case of using cut sheets of paper. The page management of cut sheets of paper is executed by detecting the leading end and trailing end of each sheet as follows. After the leading end of a cut sheet is detected, the sheet is fed by a predetermined distance so that the leading end reaches the printing position. This action is equivalent to the setting of the top of form of continuous paper, and printing will start at that position. Then, the trailing end of the cut sheet is detected. Even after the detection of the trailing end, this cut sheet still has a predetermined length of a printable area. The predetermined distance and the predetermined length are both detected by counting the number of steps. The cut sheet is discharged after a predetermined amount of printing is completed. If the printer receives the FF code during printing on one page or a paper discharge command is generated by the manipulation of a certain switch on the operating panel, the paper will be discharged compulsively. When the FF code is received, paper loading follows the paper ejection. Paper loading is carried out when the printer has received printing data. Therefore, if the printer receives new printing data in a paper empty state, or if the printer still has printing data that has left unprinted on the previous page, paper loading is carried out. Paper loading is also executed when a feed switch is operated.

What is claimed is:

1. A printer for printing on a plurality of pages, comprising: an ink ribbon having a plurality of ribbon tracks of a same color arranged side by side across said ink ribbon;

means for feeding print paper having a plurality of pages to be printed;

printing means for using an arbitrary one of said plurality of ribbon tracks to print on said print paper;

determining means for determining whether any one of a plurality of operations is executed during printing, said plurality of operations including changing said plurality of pages to be printed, feeding a top of a new page of said plurality of pages to a printing position, and loading a new print paper; and ribbon track switching means for switching said ribbon tracks prior to printing on a new page when said determining means determines that one of said operations has been executed.

2. The printer as claimed in claim 1, wherein said feeding means includes a stepping motor for feeding said paper, wherein when said paper in use is continuous paper, a number of steps of said stepping motor for feeding said paper is controlled to allow said determining means to determine a change of said plurality of pages; and wherein when said determining means determines said change of said plurality of pages has been executed, said plurality of ribbon tracks are switched from one to another by said ribbon track switching means.

3. The printer as claimed in claim 2, wherein said determining means determines a change of said plurality of pages according to whether an accumulated number of steps of said stepping motor has reached a predetermined value.

4. The printer as claimed in claim 1, wherein said determining means determines whether said operation of feeding a top of a new page of said plurality of pages to a printing position has been executed, by a form-feed operation executed upon reception of a form-feed code, and said ribbon track switching means switches said plurality of ribbon tracks when said determining means determines that said operation of feeding a top of a new page to a printing position has been executed.

5. The printer as claimed in claim 1, wherein paper to be printed upon by said ink ribbon is one of continuous paper and cut sheets of paper.

6. A method of switching a ribbon track of a plurality of ribbon tracks of a same color of an ink ribbon, said plurality of ribbon tracks of the same color being arranged side-by-side across said ink ribbon, an arbitrary one of said plurality of ribbon tracks being used to print on print paper having a plurality of pages, said method comprising the steps of:

determining whether any one of a plurality of operations is executed during printing, said plurality of operations including changing said plurality of pages to be printed, feeding a top of a new page of said plurality of pages to a printing position, and loading a new print page;

switching said ribbon tracks prior to printing on a new page when said determining means determines that one of said plurality of operations has been executed.

7. The method as claimed in claim 6, further comprising the steps of:

with continuous paper in use, controlling a number of steps of a stepping motor for feeding said paper to allow determination of a change of said plurality of pages; and switching said plurality of ribbon tracks from one to another when it is determined that said change of said plurality of pages has been executed.

8. The method as claimed in claim 7, wherein said change of said plurality of pages is determined according to whether an accumulated number of steps of said stepping motor has reached a predetermined value.

9. The method as claimed in claim 6, further comprising the steps of:

determining whether said operation of feeding a top of a new page of said plurality of pages to a printing position has been executed, by a form-feed operation executed upon reception of a form-feed code;

switching said plurality of ribbon tracks when it is determined that said operation of feeding a top of a new page to a printing position has been executed.

10. The method as claimed in claim 6, wherein said paper in use is one of continuous paper and cut sheets of paper.

11. A printer for printing data on a medium, said medium having at least one page, said printer comprising:

an ink ribbon having a plurality of ribbon tracks arranged side by side across said ink ribbon;

means for switching said ribbon tracks from one to another during a printing operation by said ink ribbon on said medium;

means for determining whether a page of said medium to be printed on is changed and for determining whether a top of a new page of said medium is fed to a printing position and for determining whether a type of medium different from that of said medium to be printed on is loaded into said printer; and means for switching said ribbon tracks from one to another upon determination by said determining means of one of said top of said new page of said medium being fed to said printing position and a type of medium different from that of said medium to be printed on being loaded into said printer.

12. A printer according to claim 11, wherein said medium includes a plurality of pages, said printer being adapted for printing on said plurality of pages of said medium, wherein, prior to printing a subsequent page, a first ribbon track of said plurality of ribbon tracks is switched to a second ribbon track of said plurality of ribbon tracks by said means for switching.

13. A printer according to claim 11, wherein said plurality of ribbon tracks have a same color.

14. A method of switching a ribbon track of a plurality of ribbon tracks of an ink ribbon for use with a printer, said method comprising the steps of:

sensing a change of pages to be printed upon by said ink ribbon in said printer;

determining a last used ribbon track of said plurality of ribbon tracks of said ink ribbon in printing a page in a printing operation by said printer; and switching said ribbon track of said plurality of ribbon tracks of said ink ribbon to another ribbon track of said plurality of ribbon tracks in response to the result of the sensing step that a page to be printed on is changed in said printer.

15. The method as claimed in claim 14, further comprising a step of providing paper to be printed upon by said ink ribbon, said paper being one of continuous paper and cut sheets of paper.

16. The method as claimed in claim 15, further comprising a step of providing said printer with a stepping motor, and a step of, with continuous paper in use, controlling a number of steps of said stepping motor for feeding said continuous paper to determine whether a printing page in said printer has been changed.

* * * * *